US006196542B1

(12) United States Patent
Allmendinger

(10) Patent No.: US 6,196,542 B1
(45) Date of Patent: Mar. 6, 2001

(54) DEVICE FOR DELIVERING, DEPOSITING, AND ALIGNING SHEETS IN A STACK CONTAINER

(75) Inventor: Franz Allmendinger, Aichwald (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/260,408

(22) Filed: Mar. 1, 1999

(30) Foreign Application Priority Data

Mar. 27, 1998 (DE) ..... 198 13 662

(51) Int. Cl.[7] ..... B65H 29/34
(52) U.S. Cl. ..... 271/189; 271/220; 271/214
(58) Field of Search ..... 271/220, 314, 271/214, 218, 189

(56) References Cited

U.S. PATENT DOCUMENTS

| | | | | |
|---|---|---|---|---|
| Re. 32,872 | * | 2/1989 | Buck | 271/218 |
| 3,847,388 | * | 11/1974 | Lynch | 271/220 |
| 4,056,264 | * | 11/1977 | Dhooge et al. | 271/314 |
| 4,385,757 | * | 5/1983 | Muller | 271/218 |
| 4,591,142 | * | 5/1986 | Divoux et al. | 271/214 |
| 4,883,265 | | 11/1989 | Iida et al. . | |
| 5,765,827 | * | 6/1998 | Gillmann | 271/220 |

FOREIGN PATENT DOCUMENTS

| | | | | |
|---|---|---|---|---|
| 146700 | * | 12/1978 | (JP) | 271/214 |
| 69449 | * | 3/1989 | (JP) | 271/220 |
| 261161 | * | 10/1989 | (JP) | 271/220 |
| 215648 | * | 8/1990 | (JP) | 271/220 |
| 403259857 | * | 11/1991 | (JP) | 271/314 |

* cited by examiner

*Primary Examiner*—H. Grant Skaggs
(74) *Attorney, Agent, or Firm*—Lawrence P. Kessler

(57) ABSTRACT

A device for delivering, depositing, and aligning sheets in a stack container of an apparatus by a sheet handling device. The sheet handling device includes a delivery mechanism delivering sheets along a sheet delivery direction, and a sheet deposition mechanism. The sheet deposition mechanism, driven in a circulating fashion, has a sheet alignment and hold-down member. The delivered and deposited sheets are aligned against a sheet stop lying at right angles to the sheet delivery direction and are held down on the sheet stack container. To provide precise, reliable, and rapid stacking of sheets, the sheet deposition mechanism is independently controlled for completely guided lowering and deposition of a delivered sheet. Moreover, the sheet deposition mechanism and the sheet alignment and hold-down member can be operated in a discontinuously circulating fashion and in synchronism with sheet delivery. Further, the sheet deposition mechanism is provided with a conveying device having at least one resilient finger for carrying a delivered sheet such that by the fingers, during their lowering movement, a delivered and fed-in sheet is carried at one of its end regions and can be lowered and deposited onto the sheet stack in uniform and completely guided fashion.

11 Claims, 4 Drawing Sheets

DEVICE FOR DELIVERING, DEPOSITING, AND ALIGNING SHEETS IN A STACK CONTAINER

CROSS-REFERENCE TO RELATED APPLICATIONS

The present application claims priority of German Patent Application Number 198 13 662.5, filed Mar. 27, 1998, by Franz Allmendinger, and entitled, "Device for Delivering, Depositing, and Aligning Sheets in a Stack Container."

FIELD OF THE INVENTION

The invention relates to a device for delivering, depositing, and aligning sheets in a stack container of an apparatus by means of sheet delivery means, sheet deposition means, sheet alignment means, and sheet hold-down means that are driven in circulating fashion such that the alignment means and hold-down means are components of the deposition means, and the delivered and deposited sheets can be aligned against a sheet stop lying at right angles to the sheet delivery direction and can be held down on the sheet stack.

BACKGROUND OF THE INVENTION

U.S. Pat. No. 4,883,265, titled "Tray Apparatus", filed Jul. 28, 1988, by Noriyoshi Iida, et al., discloses a device of the aforesaid kind for delivering, depositing, and aligning sheets in a stack container. The sheet deposition, sheet alignment, and sheet hold-down means are configured in combined fashion as at least a single toothed belt, configured in the form of an endless loop, having teeth arranged on its inner side. The toothed belt is arranged around a toothed pulley which is mounted centeredly on a drive pulley, located below, of a sheet in-feed roller pair of the sheet delivery means. The toothed belt, which projects with its free loop region into the stack container, is secured in position by means of a contact roller of the sheet in-feed roller pair on the one hand with its upper belt portion on the toothed pulley and by means of a rotation or circulation effected by means of the drive pulley, and on the other hand is pressed with its lower belt portion onto the sheet deposition surface or the sheet stack. In this context the free loop region of the toothed belt constitutes, with its outer side of its upper belt portion in the region of the toothed pulley, a transport surface running substantially horizontally and parallel to the sheet deposition surface for a sheet delivered by means of the sheet in-feed roller pair. For reliable transportation of the sheet, the outer side or transport surface has an elevated coefficient of friction. After it has been released by the sheet in-feed roller pair, the delivered or fed-in sheet, carried at its rear, end region by the upper belt portion, is fed farther into the sheet stack, lowered, and deposited onto the sheet deposition surface or onto the sheet stack. Because the sheet stack container is arranged with a downward tilt at its sheet deposition surface end which faces against the sheet delivery direction, the delivered sheet slides back, opposite to the sheet delivery direction, against the toothed belt which continues to circulate. The delivered sheet is thereby grasped by the lower belt portion and transported and aligned, opposite to the sheet delivery direction, against a front wall of the stack holder that is configured as a sheet stop and tilted against the sheet delivery direction. Arranged in the region above the upper belt portion is a pressure means which presses the delivered sheet onto the upper belt portion while it is being fed in.

It is disadvantageous that the delivered or fed-in sheet is not guided to the point of complete deposition or to the deposition surface during its lowering and deposition movement. In this case, an imprecise lateral alignment is possible as the sheets are being stacked. Furthermore, an inclined collection container is necessary in order to bring the delivered sheet once again into the region of influence of the tooth belt for alignment. The consequence of the latter, together with a longer in-feed path resulting from the toothed belt, is a longer sheet in-feed time. It is also disadvantageous that the toothed belt circulates continuously, which, when thin sheets are being aligned and held down, can lead to compression (creasing, waving, etc.) of the sheets at the sheet stop, or, regardless of the sheet thickness, to elevated material abrasion. A further disadvantage is that the toothed belt for aligning and holding down sheets does not act on the sheets at the outermost end of the delivered sheets or not directly at the sheet stop, which can result in the sheets being pushed up at the stop.

Therefore, a need persists for a device that can deliver, deposit and align sheets in a stack container that greatly reduces sheet in-feed time, virtually eliminates compression of the sheets while being easy to construct and operate, and is cost effecient to manufacture.

SUMMARY OF THE INVENTION

It is, therefore, the object of the invention to provide a device that overcomes the shortcomings cited above to allow precise, reliable, and rapid stacking of sheets, while at the same time guaranteeing a simple, compact configuration and operation in an automated environment.

The above and other objects and advantages are achieved by a device for delivering, depositing, and aligning sheets in a stack container of an apparatus by means of sheet delivery means, sheet deposition means, sheet alignment means, and sheet hold-down means that are driven in circulating fashion. According to the invention, the alignment means and hold-down means are components of the deposition means. The delivered and deposited sheets can be aligned against a sheet stop lying at right angles to the sheet delivery direction and can be held in place on the sheet stack. According to our invention, the sheet deposition means is configured in separately controllable fashion, and for completely guided lowering and deposition of a delivered sheet.

Advantageously, the sheet deposition means can be operated by means of a drive unit controllable separately from the sheet delivery means. In this way, the sheet deposition means can be moved at a lowering speed which is the same as or slightly less than the falling speed of the delivered sheet.

Also advantageously, the sheet deposition means, sheet alignment means, and sheet hold-down means can be operated in a discontinuous circulating fashion and in synchronism with sheet delivery. The sheet deposition means has conveying means having at least one circulating, resilient finger for carrying a delivered sheet. By means of the finger during its lowering movement, a delivered sheet is held at one of its end regions and can be lowered and deposited onto the sheet stack in linear and uniform fashion.

In addition, advantageously, the resilient finger(s) is/are arranged in a perpendicularly projecting alignment on one or more circulating belts running parallel and extending in the stacking direction of the sheets. Each finger has at its fingertip a lower and an upper surface region with an elevated coefficient of friction. Each resilient finger is additionally configured as an alignment means and hold-down means.

Moreover, advantageously, the sheet deposition means is arranged in the region of a sheet in-feed roller pair of the sheet delivery means and in the region of a rear wall of the collection container lying in the sheet delivery direction. The sheet deposition means is configured as a sheet stop, in such a way that the sheet deposition means is movable in the stacking direction directly along the rear wall or along the sheet stop. In addition, the sheet stop is arranged with its upper edge tilted against the sheet delivery direction and toward the sheet deposition means.

Furthermore, advantageously, the sheet deposition means has in the region of the sheet delivery means a controllable sheet pressure means that cooperates with the sheet deposition means as the sheet begins to be lowered.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
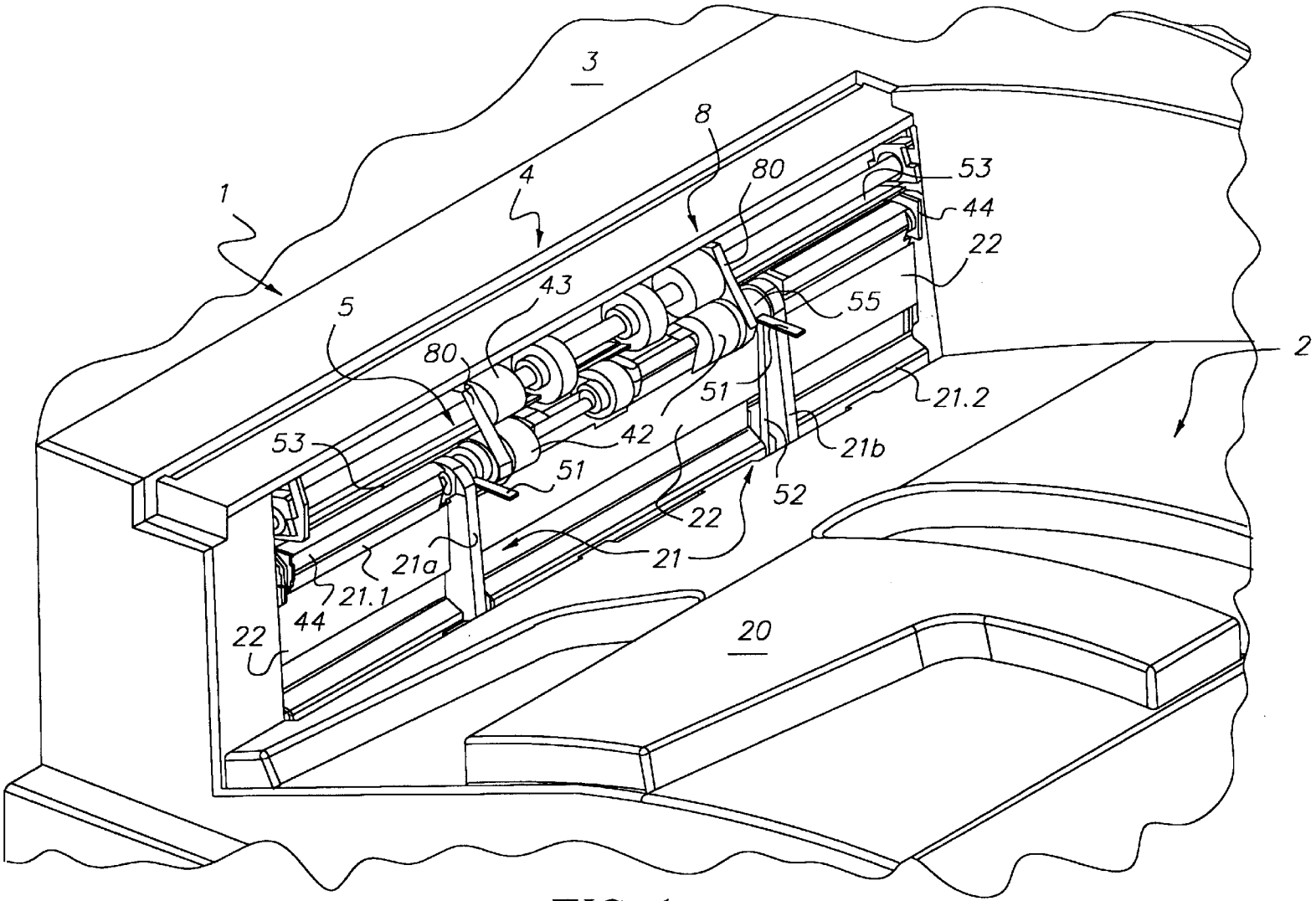
FIG. 1 is a three-dimensional depiction of the device according to the invention showing the region of a sheet stack container, all elements of the apparatus not essential to the invention being omitted.

Referring now to the drawings, and in particular to FIGS. 1–4, a preferred embodiment of device 1 of the invention is illustrated for delivering, depositing, and aligning sheets S in a stack container 2 of an apparatus 3, such as a copier or printer. Device 1 has a sheet delivery means 4, sheet deposition means 5, sheet alignment means, and sheet hold-down means that are driven in circulating fashion such that the alignment means and hold-down means are components of the deposition means 5. The delivered and deposited sheets S, S' can be aligned against a sheet stop 21 lying at right angles or transversely to sheet delivery direction X and can be held down on sheet stack ST. In this context, device 1 is used in an apparatus (not shown) of known type, for example in a copier or printer, and is preferably used to output completed customer-specific copying jobs.

Skilled artisans will appreciate that device 1 is also usable in other apparatus, for example in printers, printing presses, or sheet-sorting apparatus. Moreover, it is within the contemplation of the invention that the sheet stack container can also have (in addition to the inclined arrangement depicted and described below) a non-inclined horizontal arrangement. Further, it is contemplated that sheets of various types, for example paper, board, or film, of various thickness, sizes, and weights, can be utilized.

Figure 2:
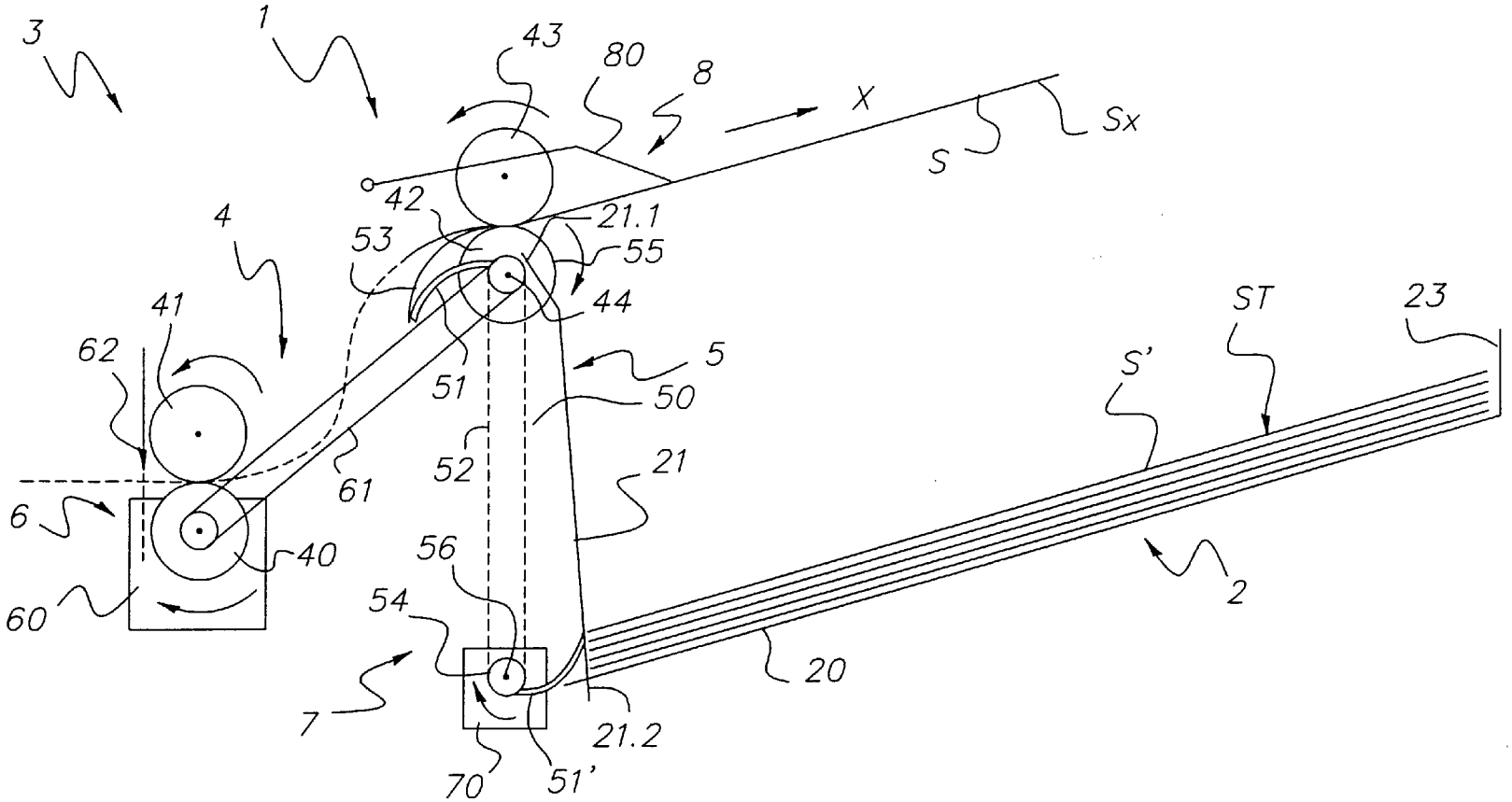
FIG. 2 is the device according to the invention as shown in FIG. 1 in a schematic side view, the device being depicted in a sheet delivery position or starting position with sheet deposition means in an initial position.

Referring to FIGS. 1–4, sheet delivery means 4 has a sheet delivery roller pair arranged toward the interior of the apparatus 3. Sheet delivery roller pair comprises lower drive roller 40 and upper pressure roller 41. A sheet in-feed roller pair is arranged in the sheet delivery direction (X) toward the exterior of the apparatus 3 and toward sheet stack holder 2. Sheet in-feed roller pair comprises lower drive roller 42 (made, for example, of foam) and upper pressure roller 43. Associated with both sheet in-feed roller pair 42, 43 and sheet delivery roller pair 40, 41 is a common drive unit 6. Drive unit 6 is controllable by a microprocessor control unit (not shown). The control unit has a stepping motor or servomotor 60 (with or without gear train) connected to drive roller 40 of sheet delivery roller pair 40, 41 and a drive belt 61 between sheet delivery drive roller 40 and sheet in-feed drive roller 42 (FIG. 2). As shown in FIG. 1, drive roller 42 and pressure roller 43 of sheet delivery roller pair 40, 41 consist of two rollers spaced apart axially next to one another.

Referring to FIG. 2, arranged in front of the sheet delivery roller pair 40, 41 is a sensor 62 by means of which a sheet delivered from the apparatus 3 can be detected at its front edge. Drive unit 6 can be activated in conjunction with the apparatus control unit.

Referring to FIG. 2, stack container 2 is configured in the form of a rectangular box open at the top and matched to the sheet formats. The rear wall of the stack container 2, oriented transversely to and against the sheet delivery direction X, serves as a sheet stop 21. Sheet stack container 2 is mounted in an inclined fashion in the apparatus 3 so that its sheet deposition surface 20 slopes downward opposite to sheet delivery direction X. Sheet stop 21 is tilted, with its upper edge 21.1 facing in stacking direction Z (see FIG. 3), opposite to sheet delivery direction X and toward sheet deposition means 5 (approx. 4 degrees).

Referring again to FIG. 2, sheet deposition means 5 is arranged in the region of sheet in-feed roller pair 42, 43 of sheet delivery means 4 and in the region of rear wall 21 of stack container 2. In this configuration, the sheet deposition means 5 is located directly along the rear wall at an acute angle corresponding to the tilt of the sheet stop 21, and can be moved up and down in stacking direction Z.

According to FIGS. 1 and 2, sheet deposition means 5 is provided with conveying means 50. Conveying means 50 comprises two resilient, i.e. bendable, fingers 51, 51' on two belts 52 which are arranged next to one another and extend parallel to or in stacking direction Z. Belts 52 circulate around drive pulleys 54 and idler pulleys 55, for carrying, lowering, and depositing a delivered sheet S (see FIG. 1). The two resilient fingers 51, 51' of each belt 52 are spaced one-half belt length (180 degrees) apart from one another. Moreover, resilient fingers 51, 51' are arranged on the outer periphery or outer surface of belts 52 in perpendicularly projecting alignment. In this case, fingers 51, 51' of the two belts 52 are arranged in alignment next to one another and constitute a first/upper 51 and a second/lower 51' finger pair. Belts 52 can be driven synchronously in a circulating direction clockwise or opposite to stacking direction Z (see FIGS. 2 through 4). Fingers 51, 51', which for example can, like the belts 52, be configured of a plastic material, have at their fingertips, viewed in the circulating direction, a front/lower 51.1 and rear/upper 51.2 surface region with an elevated coefficient of friction. Fingers 51, 51' furthermore have a length, projecting into the region of stack container 2, which has a predetermined relationship to the sheet length and to a sheet ejection speed (to be explained later).

Referring to FIG. 1, idler pulleys 55 of the two belts 52 are arranged on drive shaft 44 of sheet in-feed drive roller 42 in freely rotatable fashion by means of ball bearings and on either side of said sheet in-feed roller 42. Belt idler pulleys 55 and belt drive pulleys 54, i.e. belts 52 with fingers 51, 51', are arranged at an axial distance from one another such that a delivered and fed-in sheet S having a predetermined minimum width can be carried, lowered, and deposited. Idler pulleys 55 of belts 52 have a smaller outside diameter as compared with sheet in-feed drive roller 42, so as not to come into contact with sheet S while it is being delivered or fed in (see FIGS. 1–4). To prevent any sheet contact with resilient fingers 51, 51' while sheet (S) is being delivered and fed in, guide panels 53 are arranged above belt pulleys 54, 55 and belts 52, and below a supporting peripheral surface of sheet in-feed drive roller 42. Guide panels 53 are used for deflecting or bending aside the circulating fingers 51, 51' as they pass through this region.

As shown in FIG. 2, belt drive pulleys 54 for the two belts 52 are mounted in the region in front of a lower edge 21.2 of sheet stop 21 or of the rear wall of stack container 2, on a rotatable drive shaft 56. Belt drive shaft 56 or belt drive pulleys 54 is/are drivable clockwise, separately from sheet delivery means 4, by means of a further drive unit 7. Drive unit 7 also has a microprocessor-controlled drive motor 70 with or without gear train. In this context, belt idler pulleys 55, like belt drive pulleys 54 of conveying device 50, are configured as smooth belt pulleys or toothed-belt pulleys in accordance with the embodiment of belts 52 (smooth belts or toothed belts).

Referring to FIG. 1, sheet stop 21, defined by the front wall of stack container 2, has recesses 22 for the resilient fingers 51, 51' or finger pairs 51, 51' extending along the movement path of the fingers 51, 51' and parallel to stacking direction Z. According to FIG. 1, recesses 22 form an inlet to stack container 2 for fingers 51, 51' or finger pairs 51, 51'. Referring to FIG. 2, during the downward movement of fingers 51, 51' of deposition means 5, a delivered/fed-in sheet (S) is held and supported at its rear, end region Sy. Fingers 51, 51' is/are guided uniformly and completely and can be lowered and deposited linearly onto sheet deposition surface 20 or onto sheet stack ST in stack container 2. Belts 52, which circulate in controlled fashion, effect the downward movement of fingers 51, 51'. Sheet stop 21 (or the rear wall of stack container 2), thus consists substantially, as shown in FIG. 1, of two vertically oriented sheet stop struts 21*a*, 21*b* spaced horizontally apart.

According to FIGS. 1 and 2, resilient fingers 51, 51' are provided not only as deposition means 5 but also as alignment and hold-down means. Resilient fingers 51, 51' are correspondingly configured so that they can be respectively lowered by means of conveying means 50 onto an outermost rear, end region STy of sheet stack ST. Moreover, resilient fingers 51, 51' can be moved downward past the end face of sheet stack ST as the fingertips bend up. Hence, this movement of fingers 51, 51' can be achieved by means of their upper friction surfaces 51.2, so as to align against sheet stop 21. Further, a previously deposited sheet S' can be held down on sheet stack ST by means of fingers 51, 51' and moved by means of their lower friction surfaces 51.1 so as to align against sheet stop 21 (see FIG. 4).

Referring to FIGS. 1–4, sheet deposition means 5 has, arranged above belts 52 of conveying means 50 and sheet in-feed drive roller 42, sheet guide means 8. Sheet guide means 8 guides a sheet S, while it is being fed in, onto a finger 51 (or finger pair 51) located in an upper sheet catching position, so that when sheet S has been completely fed in, it rests with its rear, end region Sy on finger(s) 51.

The manner of operation of the device is as follows:

Referring to FIG. 2, proceeding from an assumed starting position, sheet S is delivered by means of sheet delivery roller pair 40, 41 to sheet in-feed roller pair 42, 43 in sheet delivery direction X to the stack container 2. In this embodiment, an upper or first pair of adjacently located fingers 51 of sheet deposition means 5 is located in an upper starting position or initial position, and the lower pair of fingers 51', lying next to one another, is located in a lower initial return position. Two roller pairs 40, 41; 42, 43 of sheet delivery means 4, controlled by the apparatus control unit, are operated synchronously and at a predetermined high rotation speed or at a predetermined high sheet delivery speed, by means of common drive unit 6.

Once sheet S has been sufficiently delivered to in-feed roller pair 42, 43, the rotation speed of the two roller pairs 40, 41; 42, 43 is set to a low value (e.g. a value ten times lower) corresponding to a predetermined sheet ejection speed. Sheet S is considered sufficiently delivered when only the rear, end region Sy of the sheet is still between sheet in-feed roller pair 42, 43 (not depicted), Before the delivered sheet S is released by sheet in-feed roller pair 42, 43, the upper, first finger pair 51, has ended up in a substantially horizontal position (the sheet catching position) in the upper open region of recesses 22 between sheet stop struts 21*a*, 21*b*. The upper, first finger pair 51 is controlled by the apparatus control unit and circulating clockwise by means of the further drive unit 7 associated with it, and driven at a low initial speed through guide panels 53.

After sheet S has been released by sheet in-feed roller pair 42, 43, it is laid with its rear, end region Sy, under its own weight (i.e. because of gravity) onto finger pair 51. Further, sheet S is guided by the front ends of sheet guide tongues 80 onto upper finger pair 51. The fed-in sheet S, with its front, end region Sx, is at a distance above the sheet deposition surface 20 of stack container 2 or above an already existing sheet stack ST, and is not yet touching the latter.

In the meantime, after the first fed-in sheet S has been released, drive unit 6 of sheet delivery means 4 is switched by the control unit to an intermediate sheet transfer speed (e.g. one-third of the value). This sheet transfer speed corresponds to the sheet transport speed inside the apparatus 3.

Figure 3:
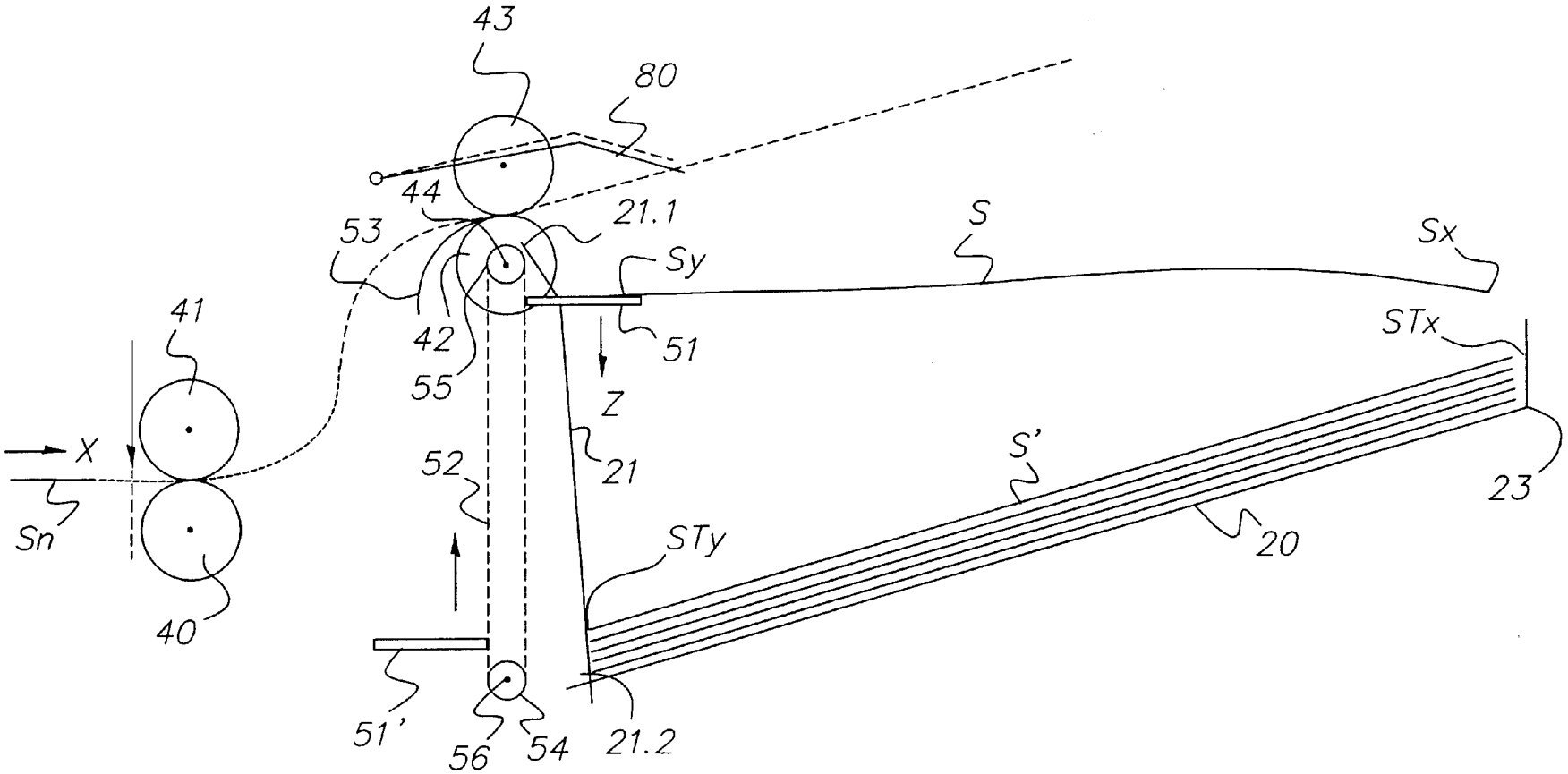
FIG. 3 is the device according to the invention as shown in FIG. 2, a portion of the deposition means being depicted in an upper sheet catching position with a sheet resting thereon and spaced against the sheet stack in the stacking direction.
Figure 4:
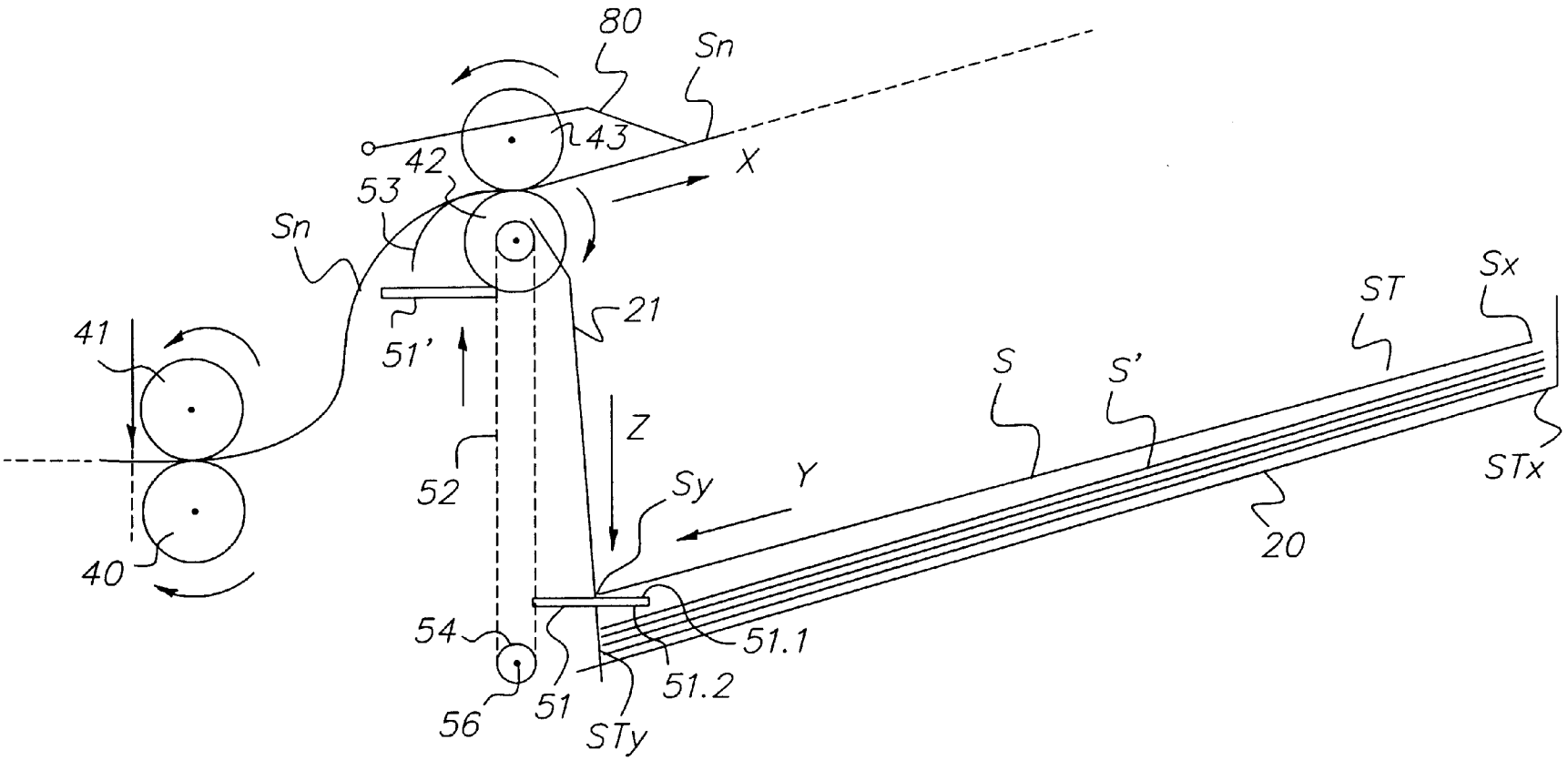
FIG. 4 is the device shown in FIGS. 2 and 3 with the sheet deposition means depicted in a sheet deposition position on the sheet stack.

Then, as shown in FIGS. 3 and 4, the upper, first finger pair 51 with sheet S is lowered vertically at an elevated and substantially constant speed (a "lowering speed") onto sheet deposition surface 20 of stack container 2. Alternatively, sheet S may be lowered onto an already stacked sheet stack ST. Belts 52 produce this linear and uniform movement of first finger pair 51. The lowering speed selected is the same as (or less than) the falling speed of sheet S so that sheet S can at all times keep up with finger pair 51 as it moves downward, and can be lowered and deposited in a completely guided fashion. The lowering speed of the upper finger pair 51 is controlled by the apparatus control unit as a function of the sheet type that is used and sensed, for example, at a somewhat slower lowering speed for very light sheets.

As shown in FIG. 4, during the lowering movement of sheet S, sheet S moves with its rear, end region Sy. This is due to the vertically tilted arrangement of sheet stop 21 and the resulting relative movement (sheet return direction) Y of sheet S, against sheet stop 21. This series of movements results additionally in a sheet alignment. The sheet alignment is promoted or enhanced by upper friction surface 51.2 of fingers 51.

As upper, first finger pair 51 moves farther downward, FIGS. 2 and 4 show that the lowered sheet S is deposited and further aligned. Further, sheet S', previously deposited onto sheet stack ST, is held down and aligned. This occurs because the upper, first finger pair 51 lies on the outermost edge of the sheet stack ST or on sheet deposition surface 20 and executes a further relative movement (sheet return direction Y) against sheet stop 21 and horizontally against sheet stack ST. As a result, upper finger pair 51 moves past the rear, end face of the sheet stack ST, or lower edge 21.2 of sheet stop 21, as the fingertips bend up. In this context, alignment of the previously deposited sheet S' is effected by lower friction surface 51.1 of fingers 51.

As shown in FIG. 4, during lowering of the first fed-in sheet S, a further sheet Sn, controlled by sensor 62, is delivered first at the intermediate sheet transfer speed. After sheet Sn is completely picked up by sheet delivery roller pair 40, 41 and sheet in-feed roller pair 42, 43, it is then delivered at the high sheet delivery speed. The high sheet delivery speed enables sheet Sn to gain time for the slower lowering and deposition of the fed-in sheet S that is limited by the falling speed of the sheet.

After the upper, first finger pair 51 has arrived in the region of lower edge 21.2, and the second, lower finger pair 51' (not in engagement) has been transported upward to the same extent by belts 52, fingers 51, 51' are then brought back down from the existing lowering speed to the lesser initial speed. Drive unit 7 associated with deposition means 5 is shut down when the lower or second finger pair 51' is in the starting position.

This sheet delivery and deposition cycle just described then repeats continuously until a desired sheet stack height or sheet count has been reached. The sheet stack height or sheet count can, for example, be determined in known fashion by means of the control unit, by counting the sheets detected by sensor 62.

In an alternative embodiment (not shown) of the invention, only one finger pair 51 or one finger 51 is arranged on each of the two belts 52. The single finger pair 51 is conveyed back into its upper starting or initial position, after a fed-in sheet S has been lowered, deposited, and aligned at a lifting speed which is considerably greater (e.g. more than twice as great) as the lowering speed. This sequence enables the finger pair to return to the initial position at the proper time before the next sheet Sn is fed in by sheet in-feed roller pair 42, 43. In addition, belt idler pulleys 55 are arranged on separate shafts that lie between sheet in-feed drive roller 42 and upper edge 21.1 of sheet stop 21.

In a further alternative embodiment (not shown) of the invention, conveying means 50 of deposition means 5 have either only one centered arranged belt 52 or in fact three belts instead of two belts. The single belt 52 or the three belts 52 each contain either one finger 51, or two fingers 51 and 51'. In this context, sheet guide tongues 80, guide panel 53, and the number of recesses 22 in the rear wall, or the number of sheet stop struts 21*a*, 21*b*, are adapted to the respective embodiments. In this embodiment, sheet guide means 8 or their tongues 80 are controlled as to position by means of a cam wheel driven by belt drive unit 7. Resilient tongues 80 can be pivoted with their front ends into an upper release position while a sheet S is being fed in, and into a lower sheet pressure position on fingers 51 or 51' after sheet S has been fed in. Also in this embodiment (not shown), the two roller pairs 40, 41; 42, 43 of sheet delivery means are replaced by a single belt drive having a sheet transport belt (e.g. a vacuum transport belt).

In a third embodiment (not shown) of the invention, deposition means 5 are arranged on a front (in sheet delivery direction X) end wall 23, configured as a sheet stop, of stack container 2. Finger pairs 51, 51' point away from the sheet delivery direction X, and are continuously moved counter-clockwise to lower a fed-in sheet S. When viewed in sheet delivery direction X, sheet stack container 2 and the sheet stop are arranged with a downward inclination or tilt.

In order to guarantee conditions which are as identical as possible when lowering, depositing, and aligning sheets S onto sheet deposition surface 20 and sheet stack ST of varying heights, stack container 2 is movable vertically upward and downward. Importantly the sheet deposition surface 20 of stack container 2 moves as a function of the sheet stack height, i.e., stack container 2 can be lowered (not shown) as the sheet stack becomes higher.

The invention has been described with reference to a preferred embodiment. However, it will be appreciated that variations and modifications can be effected by a person of ordinary skill in the art without departing from the scope of the invention.

PARTS LIST

S Delivered/fed-in sheet (to sheet stack)
S' Deposited sheet
Sn Further delivered sheet
Sx Front, end region of delivered sheet
Sy Rear, end region of delivered sheet
ST Sheet stack
STx Front end region of sheet stack
STy Rear, end region of sheet stack
X Sheet delivery direction
Y Sheet return direction
Z Sheet stacking direction
1 Device for delivering, depositing and aligning sheets
2 Stack container for collating sheets
3 Apparatus (i.e. copier)
4 Sheet delivery means
5 Sheet deposition means
6 Drive unit for sheet delivery means
7 Drive unit for sheet deposition means
8 Sheet guide means for delivered/fed-in sheet
20 Sheet deposition surface (stack container)
21 Sheet stop
21*a* Sheet stop strut
21*b* Sheet stop strut
21.1 Upper edge of sheet stop (stack container)
21.2 Lower edge of sheet stop (stack container)
22 Recess(es) on rear wall/sheet stop (stack container)
23 Front wall of stack container
40 lower drive roller of sheet delivery roller pair (sheet delivery means)
41 upper pressure roller of sheet delivery roller pair (sheet delivery means)
42 lower drive roller of sheet in-feed roller pair (sheet delivery means)
43 upper pressure roller of sheet in-feed roller pair (sheet delivery means)
44 Drive shaft of drive roller of sheet in-feed roller pair
50 Conveying means (sheet deposition means)
51 First/upper resilient finger/finger pair (conveying means)
51' Second/lower resilient finger/finger pair (conveying means)
51.1 front lower friction surface on finger
51.2 rear upper friction surface on finger
52 Belt/belts for fingers
53 Guide panel for fingers (belt drive pulley and sheet in-feed drive roller)

54 Drive pulleys for belt/belts (conveying means)
55 Idler pulleys for belt/belts (conveying means)
56 Drive shaft of drive pulley for belt/belts (conveying means)
60 Drive motor of drive unit for sheet delivery means
61 Drive belt for sheet in-feed roller pair
62 Sensor preceding sheet delivery roller pair
70 Drive motor of drive unit for conveying means
80 Sheet guide tongue (sheet guide means)

What is claimed is:

1. Device for delivering, depositing, and aligning sheets in a stack container of an apparatus by a sheet handling device, said sheet handling device comprising delivery means driven for delivery of sheets along a sheet delivery direction, and sheet deposition means driven in circulating fashion, said sheet deposition means including an alignment and hold-down member, wherein delivered and deposited sheets are aligned against a sheet stop lying at right angles to the sheet delivery direction and are held in place on the sheet stack container, said sheet deposition means independently controlled for completely guided lowering and deposition of a delivered sheet.

2. Device as defined in claim 1, wherein said sheet deposition means includes a drive motor independently controllable from the drive for said sheet delivery means; and, wherein the sheet deposition means can be driven at a sheet lowering speed which is the same as or slightly less than the falling speed of a delivered sheet.

3. Device as defined in claim 2, wherein the lowering speed is selectively controllable as a function of the sheet type.

4. Device as defined in claim 2, wherein the sheet deposition means is selectively returned at a lifting speed which is the same as or greater than the lowering speed.

5. Device as defined in claim 1, wherein the sheet deposition means can be operated in a discontinuously circulating fashion and in synchronism with sheet delivery.

6. Device as defined in claim 1, wherein said sheet delivery means includes a sheet in-feed roller pair, and said sheet deposition means is arranged proximate to said sheet in-feed roller pair, and proximate to a rear wall, lying transversely to the sheet delivery direction and configured as a sheet stop for said collection container, such that the sheet deposition means is movable in a stacking direction directly along said rear wall.

7. Device as defined in claim 1, wherein said alignment and hold-down member includes at least one resilient finger for carrying a delivered sheet, whereby the delivered sheet having end regions is held at one of the end regions for lowering and depositing onto the sheet stack in linear, uniform, and completely guided fashion.

8. Device as defined in claim 7, wherein said at least one resilient finger is arranged in a perpendicularly projecting alignment on one or more circulating belts of said alignment and hold-down member running parallel and extending in a stacking direction of the delivered sheet; and wherein each of said at least one resilient finger has a fingertip, wherein each fingertip has a lower and an upper surface region with an elevated coefficient of friction.

9. Device as defined in claim 8, wherein the sheet stop has an upper edge, said upper edge being arranged in the stacking direction arranged tilted against the sheet delivery direction and toward the sheet deposition means, such that the sheet deposition means can be moved in the stacking direction at an acute angle along the sheet stop, and wherein the stack container is inclined downward with an end of its sheet deposition surface pointing away from the sheet delivery direction.

10. Device as defined in claim 7, wherein each of said at least one resilient finger can be lowered by said alignment and hold-down member onto an outermost end region of the sheet stack, and can be moved downward past its end face in such a way that a delivered sheet, guided by means of said at least one resilient finger, can be lowered and deposited onto the sheet stack and moved so as to align against the sheet stop, and wherein a deposited sheet can be held down by said at least one resilient finger on the sheet stack and can be moved so as to align against the sheet stop.

11. Device as defined in claim 1, wherein the sheet deposition means has proximate to the sheet delivery means, controllable sheet pressure means which cooperates with said alignment and hold-down member as the delivered sheet begins to be lowered.

* * * * *